US012774652B2

(12) United States Patent
Albukhari et al.

(10) Patent No.: US 12,774,652 B2
(45) Date of Patent: Oct. 27, 2026

(54) SEALING SYSTEM FOR ROUGH COLLAR SURFACE

(71) Applicant: Halliburton Energy Services, Inc., Houston, TX (US)

(72) Inventors: Sharifah Shazanah Albukhari, Singapore (SG); MD Nazmul Haque, Singapore (SG)

(73) Assignee: Halliburton Energy Services, Inc., Houston, TX (US)

( * ) Notice: Subject to any disclaimer, the term of this patent is extended or adjusted under 35 U.S.C. 154(b) by 278 days.

(21) Appl. No.: 18/310,701

(22) Filed: May 2, 2023

(65) Prior Publication Data

US 2024/0368981 A1 Nov. 7, 2024

(51) Int. Cl.
*E21B 47/017* (2012.01)
*E21B 33/08* (2006.01)
*E21B 33/12* (2006.01)

(52) U.S. Cl.
CPC ..... *E21B 47/017* (2020.05); *E21B 33/08* (2013.01); *E21B 33/12* (2013.01)

(58) Field of Classification Search
CPC ..... E21B 33/08; E21B 33/127; E21B 33/12; E21B 47/01; E21B 47/017
See application file for complete search history.

(56) References Cited

U.S. PATENT DOCUMENTS 4,919,459 A 4/1990 Miller
5,335,731 A 8/1994 Ringgenberg et al.
5,343,944 A * 9/1994 Bassinger ..... E21B 33/08 277/505
5,538,080 A * 7/1996 Bassinger ..... E21B 33/08 277/318
5,636,688 A * 6/1997 Bassinger ..... F04B 53/164 277/516
10,309,180 B2 6/2019 Johansen et al.
11,346,161 B2 5/2022 Albukhari et al.
2003/0205864 A1* 11/2003 Dietle ..... F04B 39/04 277/434
2005/0242519 A1 11/2005 Koleilat et al.
2007/0175627 A1 8/2007 Pippert
2014/0166300 A1* 6/2014 Hall ..... E21B 43/126 166/381
2014/0284046 A1 9/2014 Bramwell
2015/0260004 A1* 9/2015 Pickle ..... E21B 33/12 166/387
2016/0326867 A1 11/2016 Prammer

FOREIGN PATENT DOCUMENTS

CN 109282038 A 1/2019

* cited by examiner

*Primary Examiner* — Yong-Suk (Philip) Ro
(74) *Attorney, Agent, or Firm* — Benjamin Ford; Parker Justiss, P.C.

(57) ABSTRACT

Provided is a sealing system, a downhole tool, and a method. The sealing system, in one aspect, includes an outer vessel housing, the outer vessel housing configured to extend around a circumference of a sensor sub, as well as a vessel cap located at one end of the outer vessel housing, the vessel cap creating a seal gland. The sealing system, in accordance with this aspect, further includes a seal stack positioned within the seal gland, and a seal retainer coupled with the vessel cap and located at least partially within the seal gland, the seal retainer configured to axially move within the seal gland to compress the seal stack and provide a fluid tight seal.

20 Claims, 5 Drawing Sheets

SEALING SYSTEM FOR ROUGH COLLAR SURFACE

BACKGROUND

Downhole tools including sensor subs often need a pressure vessel to perform sensor sub verification testing at an elevated pressure (e.g., often upwards of 100 bar, if not 145 bar or more). This sensor sub verification testing helps verify that the flowline, equalizer valve, drawdown, probe assembly, electronics, and/or seals, etc. are working as expected at the elevated pressure.

Pressure vessels are huge and costly. Moreover, there are only a limited number of pressure vessels available for use globally. Additionally, it is time consuming and costly to send the downhole tool including the sensor sub off for testing to one of the few pressure vessels found globally.

BRIEF DESCRIPTION

Reference is now made to the following descriptions taken in conjunction with the accompanying drawings, in which.

DETAILED DESCRIPTION

Figure 1:
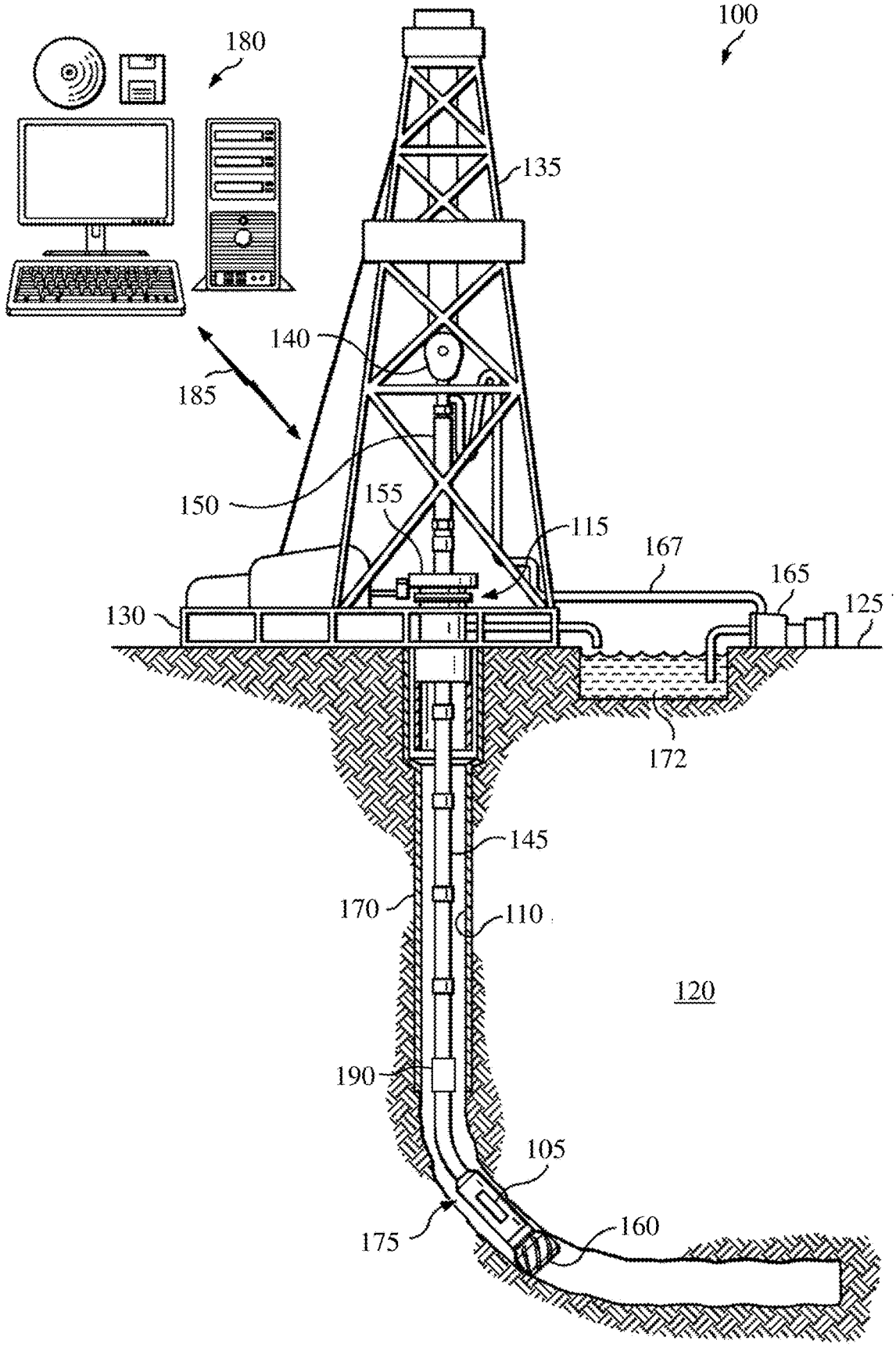
FIG. 1 illustrates is one embodiment of a well system designed, manufactured and/or operated according to one or more embodiments of the disclosure.

In the drawings and descriptions that follow, like parts are typically marked throughout the specification and drawings with the same reference numerals, respectively. The drawn figures are not necessarily to scale. Certain features of the disclosure may be shown exaggerated in scale or in somewhat schematic form and some details of certain elements may not be shown in the interest of clarity and conciseness. The present disclosure may be implemented in embodiments of different forms.

Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to direct interaction between the elements and may also include indirect interaction between the elements described. Unless otherwise specified, use of the terms "up," "upper," "upward," "uphole," "upstream," or other like terms shall be construed as generally away from the bottom, terminal end of a well, regardless of the wellbore orientation; likewise, use of the terms "down," "lower," "downward," "downhole," or other like terms shall be construed as generally toward the bottom, terminal end of a well, regardless of the wellbore orientation. Use of any one or more of the foregoing terms shall not be construed as denoting positions along a perfectly vertical axis. In some instances, a part near the end of the well can be horizontal or even slightly directed upwards. Unless otherwise specified, use of the term "subterranean formation" shall be construed as encompassing both areas below exposed earth and areas below earth covered by water such as ocean or fresh water.

The present disclosure is based, at least in part, on the recognition that a portable mini pressure vessel, such as a scaling system, may be used in lieu of the full size pressure vessels discussed above. For example, a portable mini pressure vessel may enable the user of the downhole tool to assemble the parts of the downhole tool and perform pressure tests at location, as opposed to having to send the downhole tool with sensor sub to an off-site pressure vessel. The present disclosure, however, has additionally recognized that the ability to pressurize only a certain portion of a downhole tool, which is often rough and worn-out, may be problematic.

Accordingly, the present disclosure provides a novel sealing system suitable for smooth, as well as rough and/or worn-out tubular surfaces alike. In at least one embodiment, the novel scaling system includes an outer vessel housing, the outer vessel housing configured to extend around a circumference of a sensor sub and define a pressure chamber. The novel sealing system, according to one embodiment, additionally includes a vessel cap located at one end of the outer vessel housing, the vessel cap creating a seal gland (e.g., between the vessel cap and an outer surface of the sensor sub). In accordance with one embodiment of the disclosure, one or more different types of seal stacks may be positioned within the seal gland. Furthermore, in at least one embodiment, a seal retainer may be coupled with the vessel cap and located at least partially within the seal gland. In at least this embodiment, the seal retainer is configured to axially move within the seal gland to compress the seal stack and provide a fluid tight seal, thereby completing the pressure chamber.

In certain embodiments, given the rough and/or worn-out nature of certain sensor sub surfaces, a sealant layer may be positioned in a region of the sensor sub directly radially inside of the seal gland, the sealant layer configured to smooth the rough and/or worn-out surface and improve a seal between the seal stack and the sensor sub. In at least one embodiment, the sealant layer is an elastomeric sealant layer. In yet another embodiment, the sealant layer is a fluoroelastomer sealant layer. In yet another embodiment, the sealant layer is a liquid fluoroelastomer sealant layer that cures to a solid sealant layer, as may be purchased from Pelseal Technologies, LLC under the product name PLV 2020. In many circumstances, a second vessel cap, second seal gland, second seal stack, and second seal retainer are coupled at an opposing end of the outer vessel housing to complete the pressure chamber.

Turning to FIG. 1, illustrated is one embodiment of a well system 100 designed, manufactured and/or operated according to one or more embodiments of the disclosure. The well system 100, in the illustrated embodiment, includes a downhole tool 105 (e.g., drilling system) according to one or more embodiments. It should be noted that while FIG. 1 generally depicts a land-based operation, those skilled in the art may recognize that the principles described herein are equally applicable to subsea operations that employ floating or sea-based platforms and rigs, without departing from the scope of the disclosure.

As illustrated, a wellbore 110 may extend from a wellhead 115 into a subterranean formation 120 from a surface 125. The wellbore 110 may include horizontal, vertical, slanted, curved, and other types of borehole geometries and orientations. A drilling platform 130 may support a derrick 135 having a traveling block 140 for raising and lowering a conveyance, such as drill string 145. The drill string 145 may include, but is not limited to, drill pipe and coiled tubing, as generally known to those skilled in the art. A top drive or kelly 150 may support the drill string 145 as it is lowered through a rotary table 155.

A drill bit 160 may be attached to the distal end of drill string 145 and may be driven either by a downhole motor and/or via rotation of drill string 145 from the surface 125. Without limitation, the drill bit 160 may include roller cone bits, PDC bits, natural diamond bits, any hole openers, reamers, coring bits, and the like. As the drill bit 160 rotates, it may create and extend wellbore 110 that penetrates the subterranean formation 120. A pump 165 may circulate drilling fluid through a feed pipe 167 to the kelly 150, downhole through the interior of the drill string 145, through orifices in the drill bit 160, back to the surface 125 via an annulus 170 surrounding the drill string 145, and into a retention pit 172.

The drill string 145 may begin at wellhead 115 and may traverse wellbore 110. The drill bit 160 may be attached to a distal end of the drill string 145 and may be driven, for example, either by a downhole motor and/or via rotation of the drill string 145 from the surface 125. The drill bit 160 may be a part of a bottom hole assembly 175 at a distal end of the drill string 145. The bottom hole assembly 175 may include the downhole tool 105 via threaded connections, for example. As will be appreciated by those of ordinary skill in the art, bottom hole assembly 175 may be a measurement-while drilling (MWD) or logging-while-drilling (LWD) system.

Without limitation, the downhole tool 105 may be connected to and/or controlled by an information handling system 180. Processing of information recorded may occur downhole and/or at the surface 125. Data being processed downhole may be transmitted to the surface 125 to be recorded, observed, and/or further analyzed. Additionally, the data may be stored in memory of the downhole tool 105 while the downhole tool 105 is disposed downhole.

In some examples, wireless communication may be used to transmit information back and forth between the information handling system 180 and the downhole tool 105. The information handling system 180 may transmit information to the downhole tool 105 and may receive, as well as process information recorded by the downhole tool 105. In examples, while not illustrated, the bottom hole assembly 175 may include one or more additional components, such as an analog-to-digital converter, filter and amplifier, among others, that may be used to process the measurements of the downhole tool 105 before they may be transmitted to the surface 125. Alternatively, raw measurements may be transmitted to the surface 125 from the downhole tool 105.

Any suitable technique may be used for transmitting signals from the downhole tool 105 to the surface 125, including, but not limited to, wired pipe telemetry, mud-pulse telemetry, acoustic telemetry, and electromagnetic telemetry. While not illustrated, the bottom hole assembly 175 may include a telemetry subassembly that may transmit telemetry data to the surface 125. Without limitation, an electromagnetic source in the telemetry subassembly may be operable to generate pressure pulses in the drilling fluid that propagate along the fluid stream to the surface 125. At the surface 125, pressure transducers (not shown) may convert the pressure signal into electrical signals for a digitizer (not illustrated). The digitizer may supply a digital form of the telemetry signals to the information handling system 180 via a communication link 185, which may be a wired or wireless link. The telemetry data may be analyzed and processed by the information handling system 180.

In one or more embodiments, the downhole tool 105 may additionally include a sensor sub 190. The sensor sub 190, may include a variety of different sensors and remain within the scope of the disclosure. In one example embodiment, it is necessary to conduct a tool verification test on the sensor sub 190 prior to the sensor sub 190 being run within the wellbore 110. In accordance with this embodiment, the sensor sub 190 may be verification tested using a scaling system (not shown) designed, manufactured and/or operated according to one or more embodiments of the disclosure. For example, a pressure chamber of the sealing system may be pressurized via a pressure inlet port in the outer vessel housing of the sensor sub, and then the verification test conducted. While the sensor sub 190 is illustrated in FIG. 1 as used with a downhole tool 110 comprising a drilling system, the sensor sub 190, as well as the sealing system, may be employed on any wellbore tubular and remain within the scope of the disclosure. In alternative embodiments, a sealing system according to the disclosure could be used to conduct a verification test on other subs, including the downhole tool 110, bottom hole assembly 175, etc.

Figure 2:
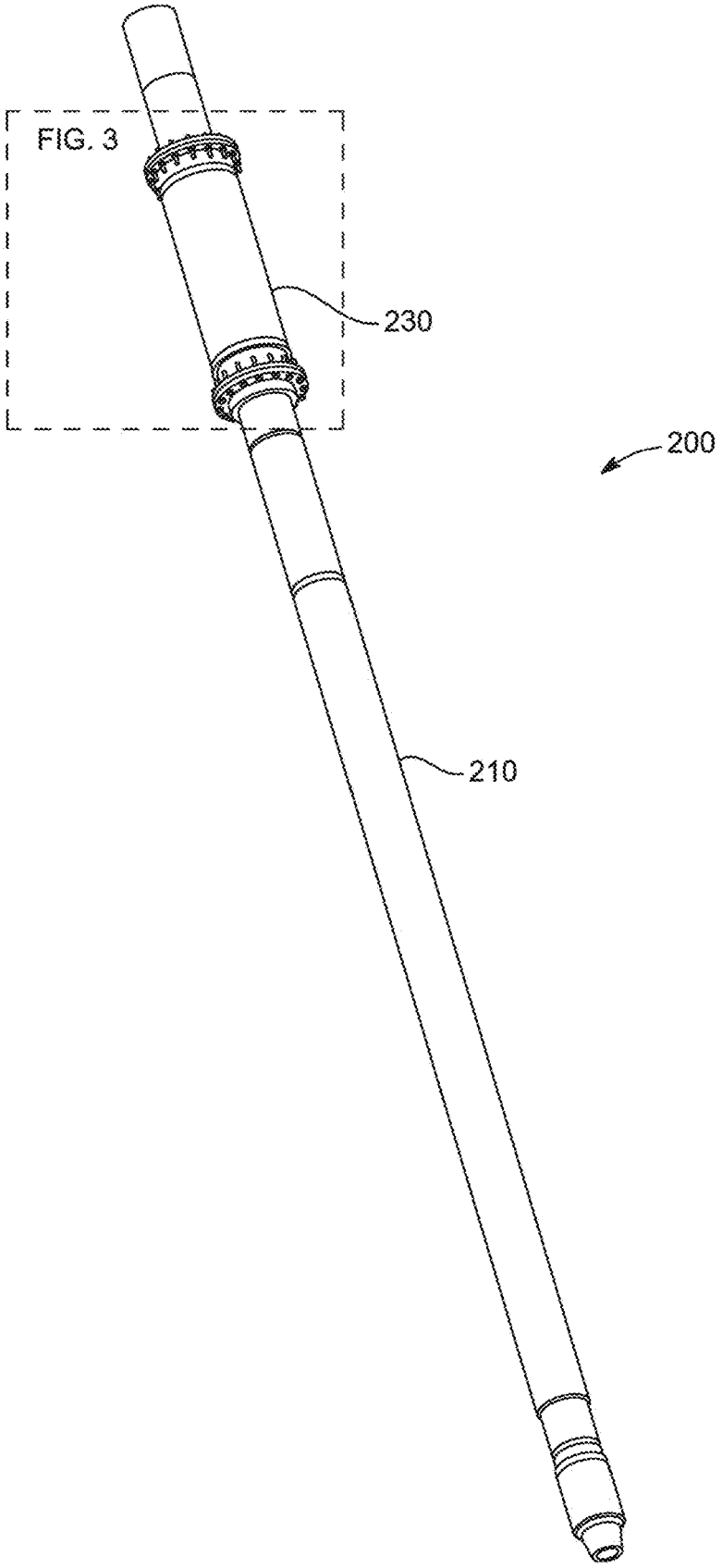
FIG. 2 illustrates is one embodiment of a downhole tool designed, manufactured and/or operated according to one or more embodiments of the disclosure.

Turning to FIG. 2, illustrated is a perspective view of a downhole tool 200 designed, manufactured and/or operated according to one or more embodiments of the disclosure. In the embodiment of FIG. 2, the downhole tool includes a wellbore tubular 210. The wellbore tubular may be any conveyance used within a well system and remain within the scope of the disclosure. In at least one embodiment, the wellbore tubular 210 is drill string, whether rigid drill string, coiled tubing, or another tubular. In at least one other embodiment, the wellbore tubular is production string, among other tubulars. The downhole tool 200, in the illustrated embodiment, additionally includes a sensor sub 220 (not illustrated in the view of FIG. 2, but illustrated in FIG. 3) surrounded by a scaling system 230.

Figure 3:
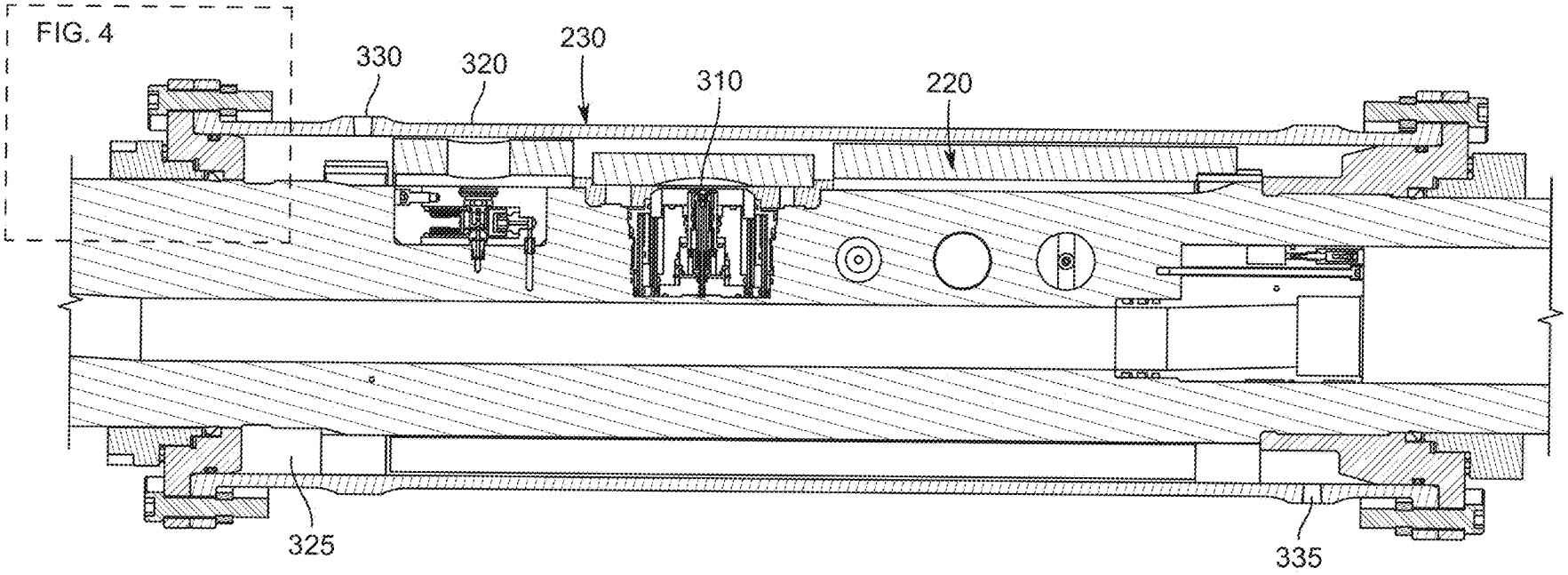
FIGS. 3 and 4 illustrate cross-sectional views of a portion of the downhole tool of FIG. 2, with particular clarity of the sensor sub and the sealing system.
Figure 4:
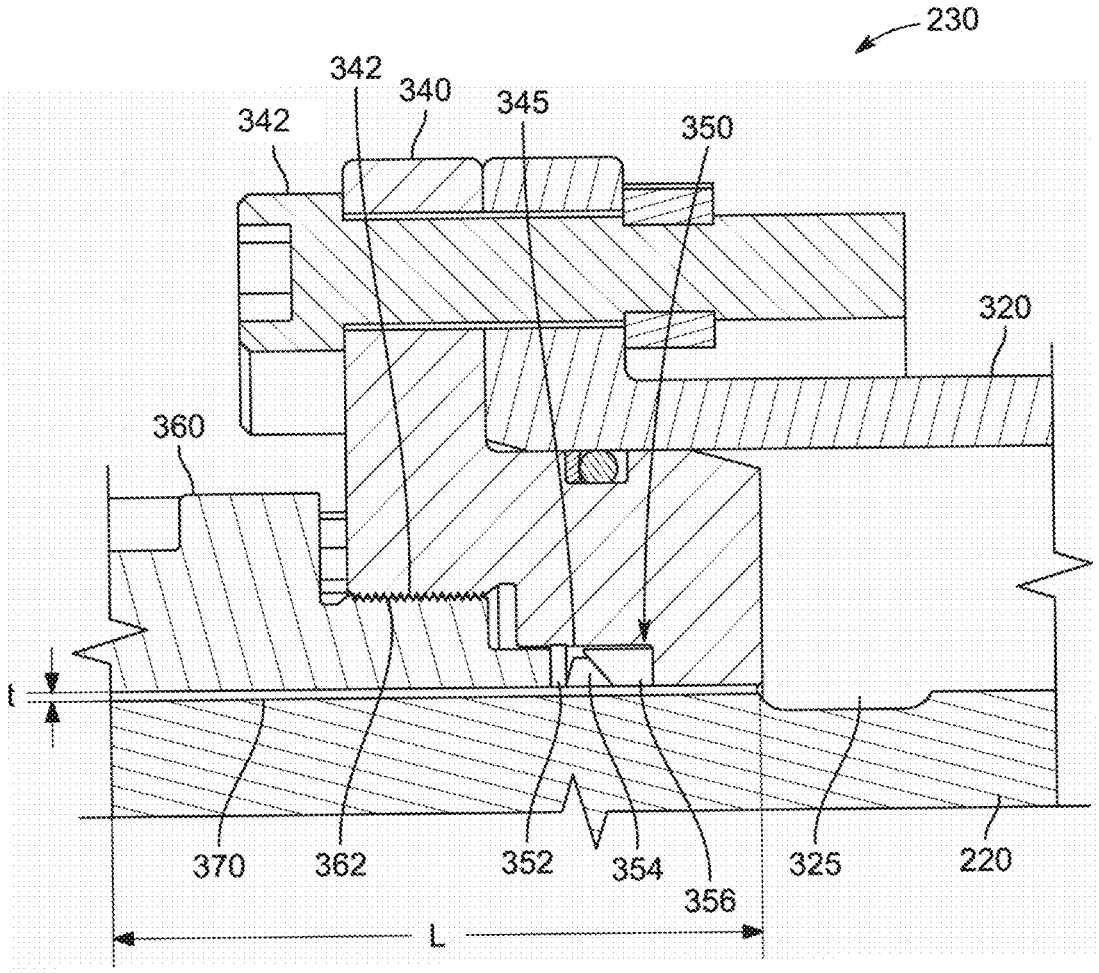

Turning to FIGS. 3 and 4, illustrated are cross-sectional views of a portion of the downhole tool 200 of FIG. 2, with particular clarity of the sensor sub 220 and the sealing system 230. The sensor sub 220, in one or more embodiments, includes one or more (e.g., a series of) sensing elements 310. The sensing elements 310, as understood in the art, may be used to sense one or more downhole conditions in and/or around the downhole tool 200. As discussed above, it is often necessary to perform a tool verification test upon the downhole tool 200, and thus the sensing elements 310, for example prior to placing the downhole tool 200 having the sensor sub 220 downhole. Thus, in the illustrated embodiment, the sealing system 230 has been placed around the sensor sub 220 for performing the aforementioned tool verification test.

The sealing system 230, in the illustrated embodiment, includes an outer vessel housing 320. In the illustrated embodiment, the outer vessel housing 320 extends around a circumference of the sensor sub 220 to define a pressure chamber 325. The outer vessel housing 320 may comprise a variety of different materials while remaining within the scope of the disclosure. However, in at least one embodiment the outer vessel housing 320 comprises a material capable of handling the 100 bar, if not 145 bar or more, that may be used in the tool verification test. Accordingly, in at least one embodiment, the outer vessel housing 320 is a metal outer vessel housing.

The outer vessel housing 320, in one or more embodiments, may include a pressure inlet port 330. The outer vessel housing 320, in one or more other embodiments, may further include a pressure outlet port 335. The pressure inlet port 330 and the pressure outlet port 335, in one or more embodiments, may be used to conduct the tool verification test discussed above. For example, the pressure chamber 325 may be pressurized through the pressure inlet port 330 in the outer vessel housing 320, and then the one or more sensing elements 310 of the sensor sub 220 may be tested under pressure.

The sealing system 230, in the illustrated embodiment, additionally includes a vessel cap 340 located at one end of the outer vessel housing 320. In the illustrated embodiment, the vessel cap 340 is connected to the outer vessel housing using an attachment feature 342 (e.g., bolt member). The vessel cap 340 may also comprise a variety of different materials while remaining within the scope of the disclosure. However, in at least one embodiment the vessel cap 340 comprises a material capable of handling the 100 bar, if not 145 bar or more, that may be used in the tool verification test. Accordingly, in at least one embodiment, the vessel cap 340 is a metal vessel cap.

The vessel cap 340, in one or more embodiments, creates a seal gland 345. For instance, the vessel cap 340 may be shaped to form the seal gland 345. The seal gland 345, in the illustrated embodiment, is at an interface between the vessel cap 340 and the sensor sub 220.

In the illustrated embodiment of FIGS. 3 and 4, a seal stack 350 is positioned within the seal gland 345. The seal stack 350 may comprise many different seal stacks and remain within the scope of the disclosure. For instance, the seal stack 350 may include one or more elastomeric elements for sealing against the vessel cap 340 and the sensor sub 220 and remain within the scope of the present disclosure. In the illustrated embodiment, however, the seal stack 350 includes a backup ring 352 and a wedged ring 356, for example separated by a compressible seal 354.

In one or more embodiments, at least one (e.g., if not both) of the backup ring 352 and the wedged ring 356 comprise a thermoplastic. For example, in one or more embodiments at least one of the back ring 352 or the wedged ring 356 comprises poly-ether-ether-ketone (PEEK), poly-ether-ketone (PEK), or poly-tetra-fluoro-ethylene (PTFE), among others. In one or more embodiments, the compressible seal 354 comprises an elastomeric seal, among others. Accordingly, as the backup ring 352 and the wedged ring 356 are compressed together, the compressible seal 354 compresses within the seal gland 345 to seal against the vessel cap 340 and the sensor sub 220.

In the illustrated embodiment, the sealing system 230 additionally includes a seal retainer 360 coupled with the vessel cap 340 and located at least partially within the seal gland 345. In accordance with one embodiment of the disclosure, the seal retainer 360 is configured to axially move (e.g., from left to right within FIG. 4) within the seal gland 345 to compress the seal stack 350 and provide a fluid tight seal. In at least one embodiment, a bolt member positioned between the seal retainer 360 and the vessel cap 340 may be used to axially move the seal retainer 360. In another embodiment, such as shown in FIG. 4, the seal retainer 360 has a first set of threads 362 configured to engage with a second set of threads 342 in the vessel cap 340. Thus, in accordance with this embodiment, the seal retainer 360 is configured to rotate about the vessel cap 340 (e.g., using the first set of threads 362 and the second set of threads 342) to axially move within the seal gland 345 and compress the seal stack 350.

In certain embodiments, as discussed above, an outer radial surface of the sensor sub 220 has a surface roughness (R) (e.g., as a result of wear and tear, damage, etc.) that prevents the seal stack 350 from making a high pressure seal when compressed. For example, in at least one embodiment, a region of the sensor sub 220 directly radially inside of the seal gland 345 has an average surface roughness ($R_a$) of at least 2 μm, if not at least 5 μm, if not at least 10 μm. In certain embodiments the average surface roughness ($R_a$) ranges from 6.3 μm to 12.5 μm.

In certain of these embodiments, a sealant layer 370 may be located along the region of the sensor sub 220 directly radially inside of the seal gland 345 to account for the average surface roughness ($R_a$). In certain other embodiments, the sealant layer 370 extends along the entire region to account for the average surface roughness ($R_a$). In yet other embodiments, the sealant layer 370 extends along the entire region and under at least a portion of the seal retainer to account for the average surface roughness ($R_a$). For example, in one or more embodiments, the sealant layer 370 has a length (L) of at least 3.75 cm, if not at least 5 cm, if not at least 7.5 cm, if not at least 10 cm, or more to account for the average surface roughness ($R_a$), depending on the size of the seal stack 350 and the size of the seal retainer 360. Ultimately, the sealant layer 370 may also be located along an inner radial surface of the seal stack 350, if not along an entire inner radial surface of the seal stack 350.

The sealant layer 370, in one or more embodiments, is an elastomeric sealant layer operable to account for the average surface roughness ($R_a$). In yet another embodiment, the sealant layer is a fluoroelastomer sealant layer. In yet another embodiment, the sealant layer is a liquid fluoroelastomer sealant layer that cures to a solid sealant layer, as may be purchased from Pelseal Technologies, LLC under the product name PLV 2020. For example, the liquid fluoroelastomer sealant layer could be deposited (e.g., sprayed) on the sensor sub 220 prior to the installation of the sealing system 230 thereon, and after curing, the sealing system 230 could be assembled on the sensor sub 220. In one or more embodiments, the sealant layer 370 has a thickness (t) of at least 0.1 mm. In yet another embodiment, the sealant layer 370 has a thickness (t) ranging from 0.2 mm to 5 mm. In yet another embodiment, the sealant layer 370 has a thickness (t) ranging from 0.5 mm to 1 mm.

The embodiment above has focused on a single side of the sealing system 230, including the vessel cap 340, the seal gland 345, the seal stack 350 and the seal retainer 360. Nevertheless, in one or more embodiments, the sealing system 230 additionally includes a second vessel cap located at an opposing end of the outer vessel housing 320 as the vessel cap 340, the second vessel cap creating a second seal gland, a second seal stack positioned within the second seal gland, and a second seal retainer coupled with the second vessel cap and located at least partially within the second seal gland, the second seal retainer configured to axially move within the second seal gland to compress the second seal stack and provide a second fluid tight seal.

Figure 5:
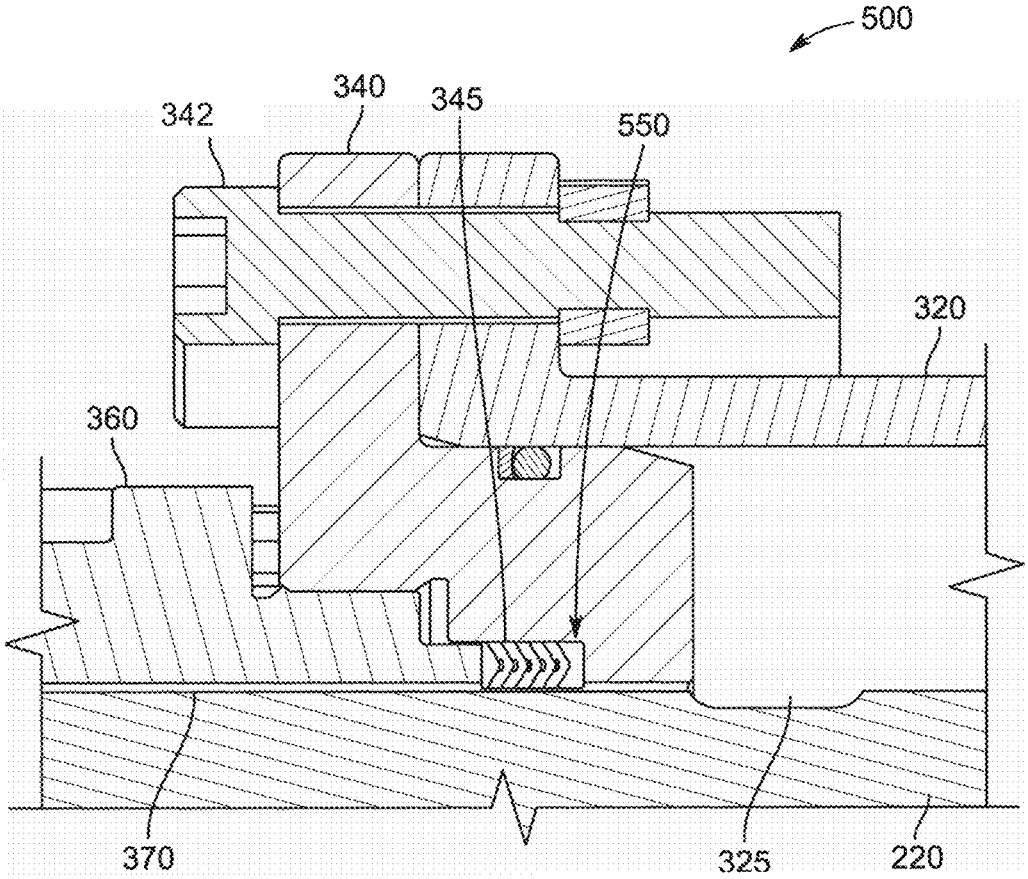
FIG. 5 illustrates a cross-sectional view of a sealing system designed, manufactured and/or operated according to an alternative embodiment of the disclosure.

Turning to FIG. 5, illustrated is a cross-sectional view of a scaling system 500 designed, manufactured and/or operated according to an alternative embodiment of the disclosure. The scaling system 500 of FIG. 5 is similar in many respects to the sealing system 230 of FIGS. 3 and 4. Accordingly, like reference numbers have been used to indicate similar, if not identical, features. The sealing system 500 differs, for the most part, from the sealing system 230 in that the sealing system 500 employs a chevron seal stack 550 including one or more compressible seals, as opposed to the seal stack 350 of FIGS. 3 and 4. The chevron seal stack 550, in accordance with one embodiment, may include one or more elastomeric sealing elements.

Aspects disclosed herein include:

A. A scaling system, the sealing system including: 1) an outer vessel housing, the outer vessel housing configured to extend around a circumference of a sensor sub and define a pressure chamber; 2) a vessel cap located at one end of the outer vessel housing, the vessel cap creating a seal gland; 3) a seal stack positioned within the seal gland; and 4) a seal retainer coupled with the vessel cap and located at least partially within the seal gland, the seal retainer configured to axially move within the seal gland to compress the seal stack and provide a fluid tight seal.

B. A downhole tool, the downhole tool including: 1) a wellbore tubular; 2) a sensor sub coupled with the wellbore tubular; and 3) a sealing system positioned about the sensor sub, the sealing system including: a) an outer vessel housing, the outer vessel housing extending around a circumference of the sensor sub and define a pressure chamber; b) a vessel cap located at one end of the outer vessel housing, the vessel cap creating a seal gland; c) a seal stack positioned within the seal gland; and d) a seal retainer coupled with the vessel cap and located at least partially within the seal gland, the seal retainer configured to axially move within the seal gland to compress the seal stack and provide a fluid tight seal.

C. A method, the method including: 1) obtaining a wellbore tubular having a sensor sub coupled thereto; and 2) positioning a scaling system about the sensor sub to form a pressure chamber, the sealing system including: a) an outer vessel housing, the outer vessel housing extending around a circumference of the sensor sub to define a pressure chamber; b) a vessel cap located at one end of the outer vessel housing, the vessel cap creating a seal gland; c) a seal stack positioned within the seal gland; and d) a seal retainer coupled with the vessel cap and located at least partially within the seal gland, the seal retainer configured to axially move within the seal gland to compress the seal stack and provide a fluid tight seal.

Aspects A, B, and C may have one or more of the following additional elements in combination: Element 1: further including a sealant layer located along an inner radial surface of the seal stack. Element 2: wherein the sealant layer extends along an entire inner radial surface of the seal stack. Element 3: wherein the sealant layer has a length (L) of at least 3.75 cm. Element 4: wherein the sealant layer has a thickness (t) ranging from 0.2 mm to 5 mm. Element 5: wherein the sealant layer comprises an elastomeric sealant layer. Element 6: wherein the sealant layer comprises a fluroelastomer sealant layer. Element 7: wherein the seal stack includes a backup ring and a wedged ring separated by a compressible seal. Element 8: wherein at least one of the backup ring or the wedged ring comprises a thermoplastic and the compressible seal comprises an elastomeric seal. Element 9: wherein the seal stack is a chevron seal stack including one or more compressible seals. Element 10: wherein the seal retainer has a first set of threads configured to engage with a second set of threads in the vessel cap, the seal retainer configured to rotate about the vessel cap to axially move within the seal gland. Element 11: wherein the vessel cap is a first vessel cap located at one end of the outer vessel housing, the seal gland is a first seal gland, the seal stack is a first seal stack, and the seal retainer is a first seal retainer, and further including: a second vessel cap located at an opposing end of the outer vessel housing, the second vessel cap creating a second seal gland; a second seal stack positioned within the second seal gland; and a second seal retainer coupled with the second vessel cap and located at least partially within the second seal gland, the second seal retainer configured to axially move within the second seal gland to compress the second seal stack and provide a second fluid tight seal. Element 12: wherein a region of the sensor sub directly radially inside of the seal gland has an average surface roughness ($R_a$) of at least 5 μm, and further including a sealant layer located along the region. Element 13: wherein the sealant layer extends entirely along the region of the wellbore tubular directly radially inside of the seal gland, and further wherein the sealant layer has a thickness (t) ranging from 0.2 mm to 5 mm. Element 14: further including pressurizing the pressuring chamber through a pressure inlet port in the outer vessel housing and then testing one or more sensing elements of the sensor sub while under pressure.

Those skilled in the art to which this application relates will appreciate that other and further additions, deletions, substitutions and modifications may be made to the described embodiments.

What is claimed is:

1. A sealing system, comprising:

an outer vessel housing, the outer vessel housing configured to extend around a circumference of a sensor sub and define a pressure chamber;

a vessel cap located at one end of the outer vessel housing, the vessel cap creating a seal gland;

a seal stack positioned within the seal gland; and a seal retainer coupled with the vessel cap and located at least partially within the seal gland, the seal retainer configured to axially move relative to the vessel cap and within the seal gland to compress the seal stack and provide a fluid tight seal.

2. The sealing system as recited in claim 1, further including a sealant layer located along an inner radial surface of the seal stack.

3. The sealing system as recited in claim 2, wherein the sealant layer extends along an entire inner radial surface of the seal stack.

4. The sealing system as recited in claim 2, wherein the sealant layer has a length (L) of at least 3.75 cm.

5. The sealing system as recited in claim 2, wherein the sealant layer has a thickness (t) ranging from 0.2 mm to 5 mm.

6. The sealing system as recited in claim 2, wherein the sealant layer comprises an elastomeric sealant layer.

7. The sealing system as recited in claim 2, wherein the sealant layer comprises a fluroelastomer sealant layer.

8. The sealing system as recited in claim 1, wherein the seal stack includes a backup ring and a wedged ring separated by a compressible seal.

9. The sealing system as recited in claim 8, wherein at least one of the backup ring or the wedged ring comprises a thermoplastic and the compressible seal comprises an elastomeric seal.

10. The sealing system as recited in claim 1, wherein the seal stack is a chevron seal stack including one or more compressible seals.

11. The sealing system as recited in claim 1, wherein the seal retainer has a first set of threads configured to engage with a second set of threads in the vessel cap, the seal retainer configured to rotate about the vessel cap to axially move within the seal gland.

12. The sealing system as recited in claim 1, wherein the vessel cap is a first vessel cap located at one end of the outer vessel housing, the seal gland is a first seal gland, the seal stack is a first seal stack, and the seal retainer is a first seal retainer, and further including:

a second vessel cap located at an opposing end of the outer vessel housing, the second vessel cap creating a second seal gland;

a second seal stack positioned within the second seal gland; and a second seal retainer coupled with the second vessel cap and located at least partially within the second seal gland, the second seal retainer configured to axially move within the second seal gland to compress the second seal stack and provide a second fluid tight seal.

13. A downhole tool, comprising:

a wellbore tubular;

a sensor sub coupled with the wellbore tubular; and a sealing system positioned about the sensor sub, the sealing system including:

an outer vessel housing, the outer vessel housing extending around a circumference of the sensor sub and define a pressure chamber;

vessel cap located at one end of the outer vessel housing, the vessel cap creating a seal gland;

a seal stack positioned within the seal gland; and a seal retainer coupled with the vessel cap and located at least partially within the seal gland, the seal retainer configured to axially move relative to the vessel cap and within the seal gland to compress the seal stack and provide a fluid tight seal.

14. The downhole tool as recited in claim 13, wherein a region of the sensor sub directly radially inside of the seal gland has an average surface roughness ($R_a$) of at least 5 μm, and further including a sealant layer located along the region.

15. The downhole tool as recited in claim 14, wherein the sealant layer extends entirely along the region of the wellbore tubular directly radially inside of the seal gland, and further wherein the sealant layer has a thickness (t) ranging from 0.2 mm to 5 mm.

16. The downhole tool as recited in claim 14, wherein the sealant layer comprises fluroelastomer sealant layer.

17. The downhole tool as recited in claim 13, wherein the seal stack includes a backup ring and a wedged ring separated by a compressible seal, or includes a chevron seal stack including one or more compressible seals.

18. The downhole tool as recited in claim 13, wherein the vessel cap is a first vessel cap located at one end of the outer vessel housing, the seal gland is a first seal gland, the seal stack is a first seal stack, and the seal retainer is a first seal retainer, and further including:

a second vessel cap located at an opposing end of the outer vessel housing, the second vessel cap creating a second seal gland;

a second seal stack positioned within the second seal gland; and a second seal retainer coupled With the second vessel cap and located at least partially within the second seal gland, the second seal retainer configured to axially move Within the second seal gland to compress the second seal stack and provide a second fluid tight seal.

19. A method, comprising:

obtaining a wellbore tubular having a sensor sub coupled thereto; and positioning a sealing system about the sensor sub to form a pressure chamber, the sealing system including:

an outer vessel housing, the outer vessel housing extending around a circumference of the sensor sub to define a pressure chamber;

a vessel cap located at one end of the outer vessel housing, the vessel cap creating a seal gland;

a seal stack positioned within the seal gland; and a seal retainer coupled with the vessel cap and located at least partially within the seal gland, the seal retainer configured to axially move relative to the vessel cap and within the seal gland to compress the seal stack and provide a fluid tight seal.

20. The method as recited in claim 19, further including pressurizing the pressuring chamber through a pressure inlet port in the outer vessel housing and then testing one or more sensing elements of the sensor sub While under pressure.

* * * * *